US012760992B1

(12) United States Patent
McGuire

(10) Patent No.: US 12,760,992 B1
(45) Date of Patent: Oct. 13, 2026

(54) SMART SYSTEM FOR A HOLSTER AND METHODS OF MAKING AND USING THE SAME

(71) Applicant: McGuire Technology Group LLC, Deland, FL (US)

(72) Inventor: Jonathan McGuire, Deland, FL (US)

(73) Assignee: McGuire Technology Group LLC, Deland, FL (US)

( * ) Notice: Subject to any disclaimer, the term of this patent is extended or adjusted under 35 U.S.C. 154(b) by 0 days.

(21) Appl. No.: 18/516,808

(22) Filed: Nov. 21, 2023

Related U.S. Application Data

(60) Provisional application No. 63/384,681, filed on Nov. 22, 2022.

(51) Int. Cl.
*F41C 33/02* (2006.01)

(52) U.S. Cl.
CPC ..... *F41C 33/029* (2013.01)

(58) Field of Classification Search
CPC ..... F41C 33/029
See application file for complete search history.

(56) References Cited

U.S. PATENT DOCUMENTS 12,188,745 B1 * 1/2025 Salazar ..... F41C 33/029
2015/0256990 A1 * 9/2015 Vilrokx ..... H04W 76/50 455/404.1
2016/0086472 A1 * 3/2016 Herrera ..... F41C 33/029 340/539.11
2016/0165192 A1 * 6/2016 Saatchi ..... H04N 7/185 386/227
2017/0074617 A1 * 3/2017 Stewart ..... H04W 4/80
2018/0151057 A1 * 5/2018 Reyna ..... H04W 4/02
2021/0125443 A1 * 4/2021 Lalicki ..... G16Y 40/50

FOREIGN PATENT DOCUMENTS

BR 102021021449 A2 * 5/2023

OTHER PUBLICATIONS

Axon: "Axon Signal Sidearm User Manual", 2022, pp. 1-28, https://my.axon.com/sfc/servlet.shepherd/document/download/069f3000006KoK3AAK.

* cited by examiner

*Primary Examiner* — Daryl C Pope
(74) *Attorney, Agent, or Firm* — NK Patent Law

(57) ABSTRACT

This disclosure presents methods, systems, and devices for monitoring usage of a holster. In one embodiment, a system is disclosed for mechanically coupling with a holster. The system includes a controller, a communication interface electrically coupled with the controller; and a user interface electrically coupled with the controller. The user interface is configured to allow a user wearing the holster to activate transmission of a distress signal via the communication interface.

20 Claims, 9 Drawing Sheets

SMART SYSTEM FOR A HOLSTER AND METHODS OF MAKING AND USING THE SAME

PRIORITY CLAIM

This application claims priority to U.S. Provisional Patent Application Ser. No. 63/384,681 filed Nov. 22, 2022, entitled "SMART SYSTEM FOR A HOLSTER AND METHODS OF MAKING AND USING THE SAME,". The disclosure of the aforementioned application is incorporated herein by reference in its entirety.

TECHNICAL FIELD

The present invention relates to holsters. More specifically this disclosure presents improved weapon holsters for law enforcement.

BACKGROUND

Law enforcement accountability is more important than ever in today's society and thousands of police-involved shootings occur each year impacting both police officers as well as citizens lives. Currently, there is no easy way to log, pinpoint, identify, collect data for handgun use in the context of law enforcement or military operations.

As such new methods, devices, and systems are needed for monitoring handgun use for licensed individuals.

SUMMARY

This disclosure presents methods, systems, and devices for methods, systems, and devices for monitoring usage of a holster.

In one embodiment, a system is disclosed for mechanically coupling with a holster. The system includes a controller, a communication interface electrically coupled with the controller; and a user interface electrically coupled with the controller. The user interface is configured to allow a user wearing the holster to activate transmission of a distress signal via the communication interface. In further embodiments, the communication interface may be a wireless communication interface.

In some embodiments, the holster may be configured to restrict undesired movement of a tool positioned within the holster. The user interface may be configured to be positioned on the holster to allow a hand of the user to be positioned for removing the tool from the holster while activating the user interface. In further embodiments, the tool may be a handgun, an electroshock weapon, a spray canister, and/or the like.

In some embodiments, the controller may be configured to receive location data associated with the holster and the distress signal may include the location data. In further embodiments, the system may include a satellite navigation receiver electrically coupled with the controller and the satellite navigation receiver may be configured to determine the location data.

In another embodiment, a system includes a controller, a communication interface electrically coupled with the controller, a user interface electrically coupled with the controller, and a first sensor arrangement electrically coupled with the controller. The first sensor arrangement is configured for detecting removal of a tool from the holster.

In some embodiments, the user interface may be configured to activate a transmission of a distress signal.

In some embodiments, the holster may be configured to restrict undesired movement of the tool. In further embodiments, the tool may be a handgun, an electroshock weapon, a spray canister, and/or the like. In still further embodiments, the handgun may be a semi-automatic pistol, a revolver, and/or the like. In certain embodiments, the semi-automatic pistol may be a Glock® 17 semi-automatic pistol, Glock® 19 semi-automatic pistol, a Glock® 21 semi-automatic pistol, a Sig Sauer® P226 semi-automatic pistol, and/or the lock.

In some embodiments, the electroshock weapon may be a taser.

In some embodiments, the spray canister may be a pepper spray canister. In further embodiments, the pepper spray canister may have a concentration of capsaicinoids between 0.18 percent and 3.00 percent. In certain embodiments, the pepper spray canister may have a concentration of capsaicinoids between 1.00 percent and 2.0 percent. In other embodiments, the spray canister may contain a concentration of o-chlorobenzylidene malononitrile, pelargonic acid vanillylamide, and/or the like.

In some embodiments, the communication interface may be a wireless communication interface. In further embodiments, the wireless communication interface may be configured to communicate over a personal area network. In certain embodiments, the personal area network may be compliant with at least one version of a Bluetooth® standard.

In some embodiments, the wireless communication interface may be configured to communicate over a local area network. In certain embodiments, the local area network may be compliant with at least one version of an 802.11 standard.

In some embodiments, the wireless communication interface may be configured to communicate over a wide area network. In further embodiments, the wide area network may be a cellular network. In certain embodiments, the cellular network may be compliant to a 2G network, a 3G network, a 4G network, and/or a 5G network.

In some embodiments, the controller may be further configured for transmitting a message via the communication interface to an external computing device upon detecting activation of the user interface (e.g., a distress signal). In further embodiments, the external computing device may be a mobile computing device associated with a user of the system. In certain embodiments, the mobile computing device may be a smart phone, a smart tablet, a smart watch, and/or the like. In other embodiments, the external computing device may be located within a law enforcement vehicle, a law enforcement command center, and/or the like.

In some embodiments, the controller may be configured for transmitting a message via the communication interface to an external computing device upon detecting the tool being removed from the holster. In certain embodiments, the first sensor arrangement may include an inductive proximity sensor, a capacitive sensor, an ultrasonic sensor, and/or the like.

In some embodiments, the system may further include a second sensor arrangement electrically coupled with the controller. The second sensor arrangement may be configured for detecting presence of a hand positioned for removal of the tool. In further embodiments, the controller may be configured for transmitting a message via the communication interface to an external computing device upon detecting the presence of the hand positioned for removing the tool from the holster. In certain embodiments, the second sensor arrangement may include an infrared proximity sensor, a capacitive proximity sensor, and/or the like.

In some embodiments, the system may further include a third sensor arrangement electrically coupled with the controller. The third sensor arrangement may be configured for detecting the holster being removed from a user wearing the holster, detecting the system being removed from the holster, and/or the like. In certain embodiments, the third sensor arrangement may include an infrared proximity sensor, a capacitive proximity sensor, and/or the like.

In some embodiments, the system may further include a satellite navigation receiver electrically coupled with the controller. The satellite navigation receiver may be configured to determine an approximate location of the system. In further embodiments, the satellite navigation receiver may be configured to receive navigation signals from the Global Positioning System (GPS), the Global Navigation Satellite System (GLONASS), the BeiDou Navigation Satellite System (BDS), the Galileo Global Navigation Satellite System, the Quasi-Zenith Satellite System (QZSS), the Indian Regional Navigation Satellite System (IRNSS), and/or the like.

In some embodiments, wherein the controller may be further configured to transmit a message including the approximate location of the system upon detecting activation of the user interface and/or detecting the tool being removed from the holster.

In some embodiments, the system may further include the holster. In certain embodiments, the system may further include the tool.

In certain embodiments, the holster may be configured to be mechanically coupled with a belt, a shoulder harness, a calf strap, an ankle band, a waist band, a vest, a jacket, and/or the like.

In some embodiments, the system may further include an accelerometer sensor electrically coupled with the controller and configured to detect movement of the holster.

In some embodiments, the system may further include a tilt sensor electrically coupled with the controller and configured to detect a relative position of the holster.

In another embodiment, a method of manufacturing a system for monitoring usage of a holster is disclosed. The method includes electrically coupling a communication interface with a controller and electrically coupling a first sensor arrangement with the controller. The first sensor arrangement is configured for detecting removal of a tool from the holster. The method further includes electrically coupling a user interface with the controller.

In some embodiments, the method may further include mechanically coupling the communication interface, the controller, the first sensor arrangement, and the user interface to the holster.

In some embodiments, the method may further include electrically coupling a second sensor arrangement with the controller and the second sensor arrangement may be configured for detecting presence of a hand positioned for removal of the tool. In further embodiments, the method may further include mechanically coupling the second sensor arrangement to the holster.

In some embodiments, the method may further include electrically coupling a third sensor arrangement with the controller and the third sensor arrangement may be configured for detecting the holster being removed from a user wearing the holster and/or detecting the system being removed from the holster. In further embodiments, the method may further include mechanically coupling the third sensor arrangement to the holster.

In some embodiments, the method may further include electrically coupling a satellite navigation receiver with the controller and the satellite navigation receiver may be configured to determine an approximate location of the system. In further embodiments, the method may further include mechanically coupling the satellite navigation receiver to the holster.

In some embodiments, the method may further include electrically coupling an accelerometer sensor with the controller and the accelerometer sensor may be configured to detect movement of the holster. In further embodiments, the method may further include mechanically coupling the accelerometer sensor to the holster.

In some embodiments, the method may further include electrically coupling a tilt sensor with the controller and the tilt sensor may be configured to detect a relative position of the holster. In further embodiments, the method may further include mechanically coupling the tilt sensor to the holster.

The features and advantages described in this summary and the following detailed description are not all-inclusive. Many additional features and advantages will be apparent to one of ordinary skill in the art in view of the drawings, specification, and claims presented herein.

DETAILED DESCRIPTION

Figure 1:
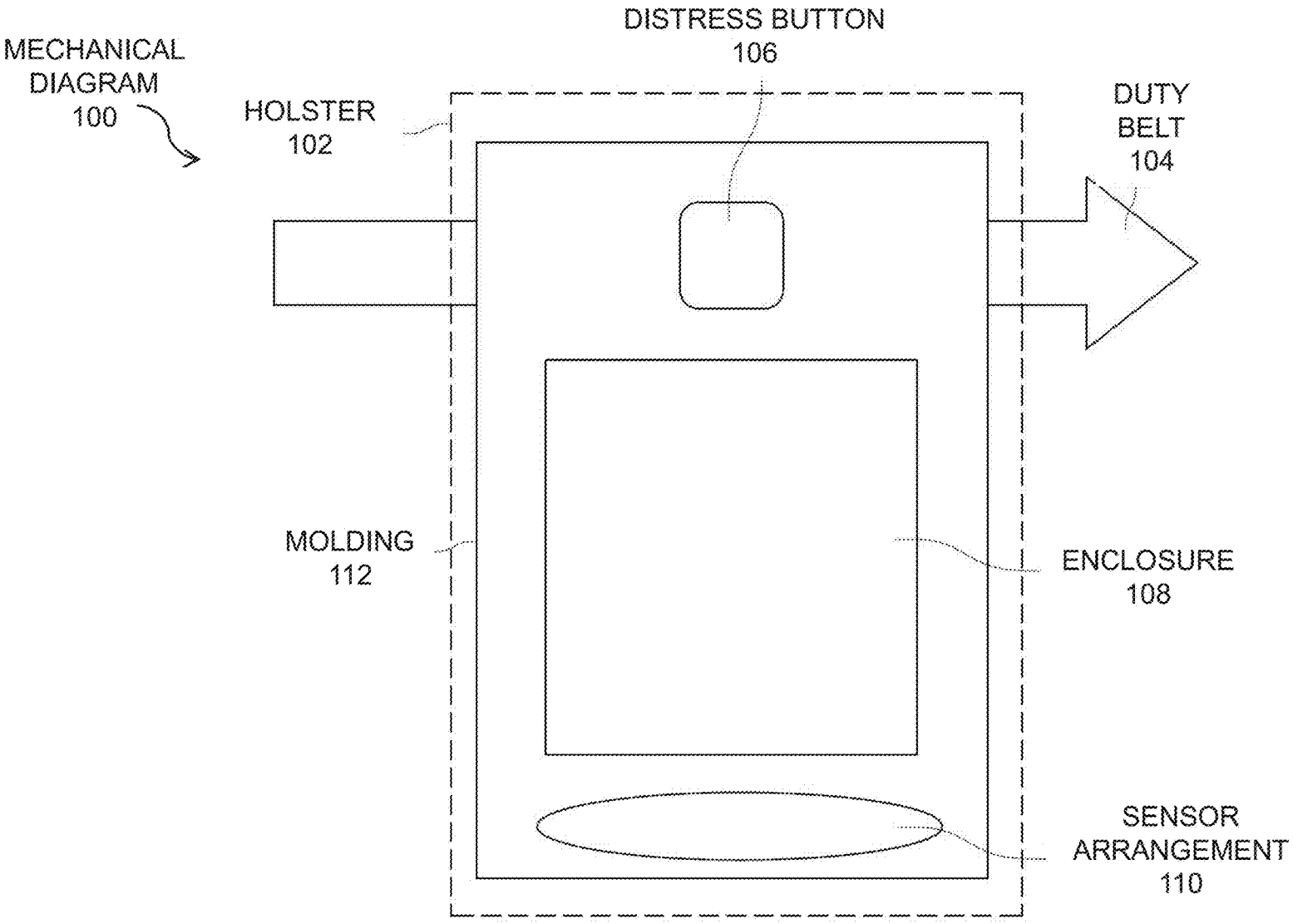
FIG. 1 depicts a mechanical diagram illustrating a view of a holster with the wearer (i.e., user) facing sideways in accordance with embodiments of the present disclosure.

The following description and drawings are illustrative and are not to be construed as limiting. Numerous specific details are described to provide a thorough understanding of the disclosure. However, in certain instances, well-known or conventional details are not described in order to avoid obscuring the description. References to "one embodiment"

or "an embodiment" in the present disclosure can be, but not necessarily are, references to the same embodiment and such references mean at least one of the embodiments.

Reference in this specification to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way.

Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification, including examples of any terms discussed herein, is illustrative only, and is not intended to further limit the scope and meaning of the disclosure or of any exemplified term. Likewise, the disclosure is not limited to various embodiments given in this specification.

Without intent to limit the scope of the disclosure, examples of instruments, apparatus, methods and their related results according to the embodiments of the present disclosure are given below. Note that titles or subtitles may be used in the examples for convenience of a reader, which in no way should limit the scope of the disclosure. Unless otherwise defined, all technical and scientific terms used herein have the same meaning as commonly understood by one of ordinary skill in the art to which this disclosure pertains. In the case of conflict, the present document, including definitions, will control.

Disclosed herein are methods, systems, and devices for monitoring usage of a holster. Of specific interest are holsters with firearms for law enforcement and military personnel. These methods, systems, and devices provide real time data to drive analytics, real-time analysis, and relay real-time intelligence. The methods, systems, and devices enable promoting of accountability, allow a distress beacon, after actions analysis and/or reports, real-time intelligence to send help in the form of backup or medical, real-time intelligence to be coached through a situation, and real-time location intelligence.

This data can be further used to identify analytics such as, patrolling routes, route versus crime statistics, how many weapon draws an officer has had, average time the weapon was drawn, how long each encounter or draw lasted, alerting dispatch or other officers that a weapon was drawn or fired, how dangerous a specific area is versus another, etc.

FIG. 1 depicts a mechanical diagram 100 illustrating a view of a holster 102 with the wearer (i.e., user) facing sideways in accordance with embodiments of the present disclosure. The holster 102 includes a system for monitoring usage of the holster 102. An arrow 104 symbolizes a duty belt supporting the holster 102. The arrow 104 is pointing toward the front of the wearer. The holster (i.e., system) includes a distress button 106 (e.g., "officer needs assistance" button) positioned on the side of the holster 102. In other scenarios, the distress button 106 may be positioned on either the front, back, top, or bottom of the holster 102. An enclosure 108 includes a battery, a controller, and a communication interface. A sensor arrangement 110 (e.g., pressure switch, etc.) is configured to detect presence of a weapon in the holster. Molding 112 secures the weapon in place.

Figure 2:
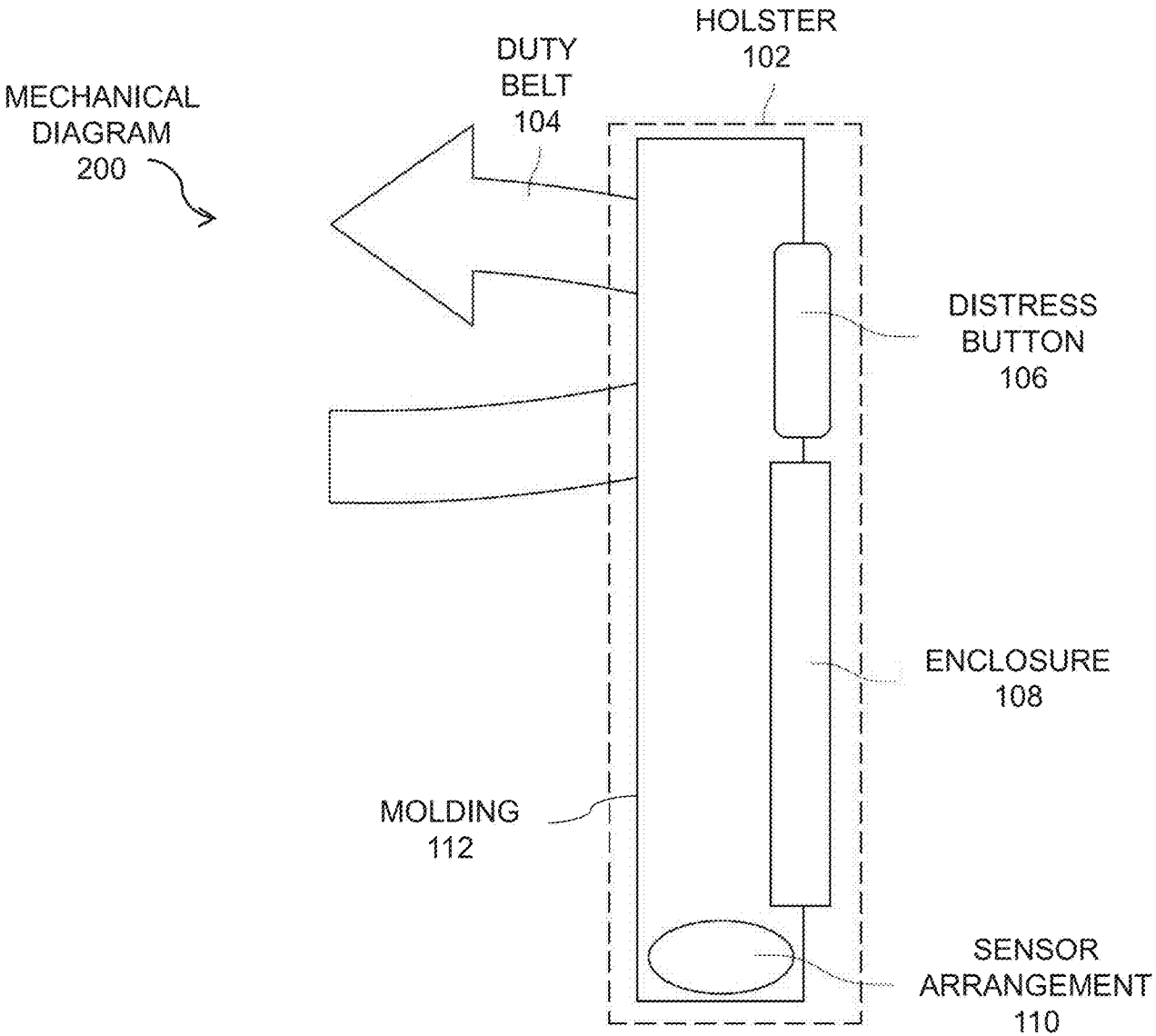
FIG. 2 depicts a mechanical diagram illustrating a view of the holster of FIG. 1 with the wearer facing the front in accordance with embodiments of the present disclosure.

FIG. 2 depicts a mechanical diagram 200 illustrating a view of the holster 102 of FIG. 1 with the wearer facing the front in accordance with embodiments of the present disclosure.

In a first use case, an officer needs to deploy their weapon. The officer removes their weapon from the holster 102. The sensor arrangement 108 detects the weapon has been deployed. The controller logs the event start time as well as relays the use of the weapon with time and location locally and/or remotely via the communication interface.

In a second use case, the officer returns his weapon to the holster 102. The sensor arrangement 108 detects the weapon returning to the holster 102. The controller logs the event end time as well as relays the retention of the weapon with time and location locally and/or remotely via the communication interface remotely to other devices or servers.

In a third use case, the officer determines they need assistance. The officer activates the distress button 104 for three seconds or more. The controller logs the event time, sends an active alert with time and location to a local device via the communication interface. The controller may also send the data locally and/or remotely to other devices or servers.

In a fourth use case, the officer is fighting for retention of his weapon against a suspect. The holster 102 (i.e., system) determines by one or more additional sensors (not shown if FIG. 1 and FIG. 2) a pattern of frequent weapon movement indicating a possible struggle. The additional sensors may include an accelerometer sensor and/or a tilt sensor. The controller logs the event time, sends an active alert with time and location to the local device. The controller may also send the data locally and/or remotely to other devices or servers.

Benefits of the holster 102 include reducing risk of severe injury or death to the officer, the suspect, and/or the general public. The holster 102 allows the officer, if attacked, to call for backup instantly while fighting for retention of his weapon with the same hand. The holster 102 promotes accountability of proper weapon usage, initial review, after action review and investigations as follow up to an incident. Further benefits of the holster 102 include reduction of liability for law enforcement departments, loss of life, enhancement to taxpayer safety, and enhancement to officer safety by getting medical help or backup sooner.

The holster 102 allows for real-time intelligence for dispatch, other officers, supervisors, or other authorized personnel to assist that officer immediately. Additional safety for the officer is provided by automatic non-officer-initiated alerts in the case of a possible struggle with a suspect.

The events logged by the holster 102 further facilitate follow-up administrative investigations. These features allow departments to analyze data to determine a variety of things such as weapon usage per officer, which areas geographically are the most dangerous by having to deploy a weapon, weapon usage auditing, whether a particular officer has a history of being more aggressive, etc.

Figure 3:
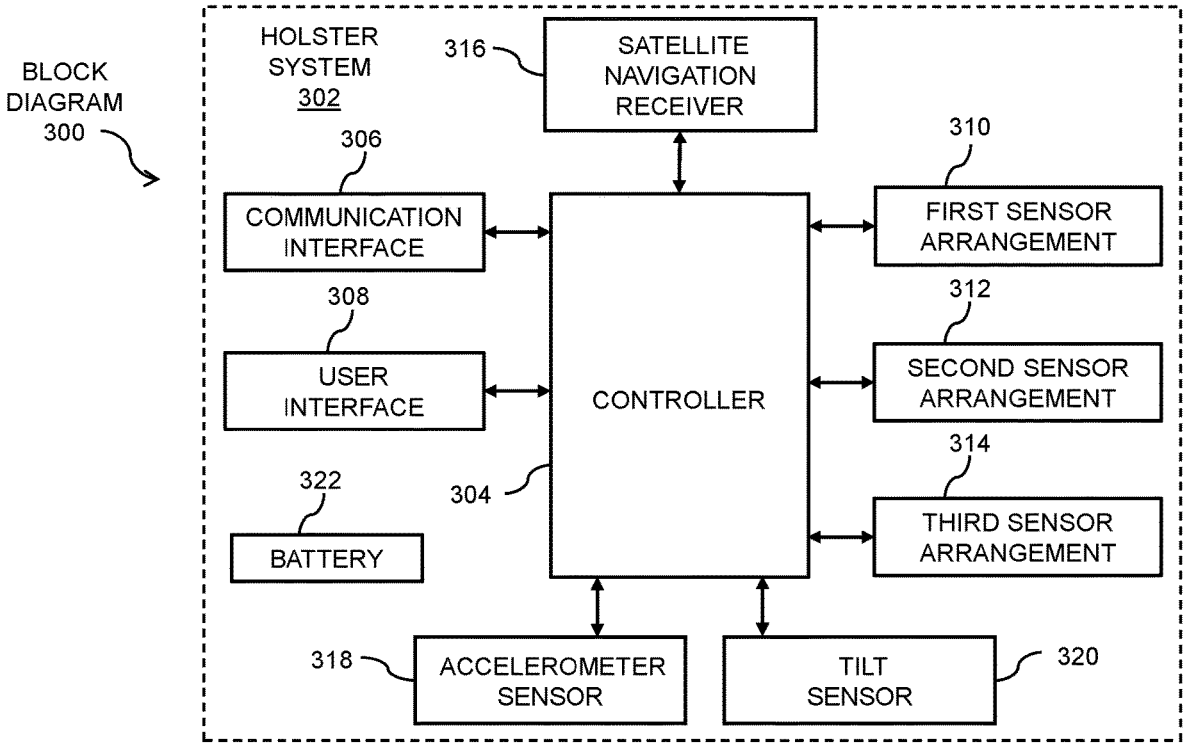
FIG. 3 depicts a block diagram illustrating a holster system that may be used with the holster of FIG. 1 and FIG. 2 (or other tools) in accordance with embodiments of the present disclosure.

In a broader embodiment, FIG. 3 depicts a block diagram 300 illustrating a holster system 302 that may be used with the holster 102 of FIG. 1 and FIG. 2 (or other tools) in accordance with embodiments of the present disclosure. The holster may be configured to restrict undesired movement of a tool. The tool may be a handgun, an electroshock weapon, a spray canister, and/or the like (as outlined in the Summary Section). The holster may be mechanically coupled with a belt, a shoulder harness, a calf strap, an ankle band, a waist band, a jacket, a vest, and/or the like.

The holster system 302 includes a controller 302 electrically coupled with a communication interface 306, a user interface 308, a first sensor arrangement 310, a second sensor arrangement, 312, a third sensor arrangement 314, a satellite navigation receiver 318, an accelerometer sensor 318, and a tilt sensor 320.

The communication interface 306 may be a wireless communication interface. The communication interface 306 may be configured to communicate over a personal area network, a local area network, and/or a wide area network. The personal area network may be compliant with at least one version of a Bluetooth® standard. The local area network may be compliant with at least one version of an 802.11 standard. The wide area network may be a cellular network. The cellular network may be compliant with a 2G network, a 3G network, a 4G network, a 5G network, and/or the like.

The user interface 308 may be a mechanical switch or a capacitive switch allowing momentary contact for activation by a user of the holster system 302 (including the holster with the tool). The controller 302 may be further configured for transmitting a message via the communication interface to an external computing device upon detecting activation of the user interface 308. The external computing device may be a mobile computing device associated with a user of the holster system 302 (i.e., holster). The mobile computing device may be a smart phone, a smart tablet, a smart watch, and/or the like. In another scenario, the external computing device may be a relay computing device and/or a server located within a law enforcement vehicle, a law enforcement command center, and/or the like.

The first sensor arrangement 310 is configured for detecting removal of a tool (e.g., handgun, etc.) from the holster. The first sensor arrangement 310 may include an inductive proximity sensor, a capacitive sensor, an ultrasonic sensor, and/or the like. The controller 304 may be configured for transmitting a message via the communication interface 306 to the external computing device upon detecting the tool being removed from the holster.

The second sensor arrangement 312 may be configured for detecting presence of a hand positioned for removal of the tool. The second sensor arrangement 312 may include an infrared proximity sensor, a capacitive proximity sensor, and/or the like. The controller 304 may be configured for transmitting a message via the communication interface 306 to the external computing device upon detecting the presence of the hand positioned for removing the tool from the holster.

The third sensor arrangement 314 may be configured for detecting the holster being removed from a user wearing the holster, detecting the system being removed from the holster, and/or the like. The third sensor arrangement 312 may include an infrared proximity sensor, a capacitive proximity sensor, and/or the like. The controller 304 may be configured for transmitting a message via the communication interface 306 to the external computing device upon detecting the holster being removed from a user wearing the holster, detecting the system being removed from the holster, and/or the like.

The satellite navigation receiver 316 may be configured to determine an approximate location of the holster system 302. In further embodiments, the satellite navigation receiver may be configured to receive navigation signals from the Global Positioning System (GPS), the Global Navigation Satellite System (GLONASS), the BeiDou Navigation Satellite System (BDS), the Galileo Global Navigation Satellite System, the Quasi-Zenith Satellite System (QZSS), the Indian Regional Navigation Satellite System (IRNSS), and/or the like. The controller 304 may be further configured to transmit a message including the approximate location of the system upon detecting activation of the user interface 308, detecting the tool being removed from the holster, detecting the presence of the hand positioned for removing the tool from the holster, detecting the holster being removed from a user wearing the holster, detecting the system being removed from the holster, and/or the like.

The accelerometer sensor 318 is configured to detect movement of the holster. The tilt sensor 320 is configured to detect a relative position of the holster. The accelerometer 318 and the tilt sensor 320 may also facilitate the controller 304 in detecting the tool being removed from the holster, detecting the presence of the hand positioned for removing the tool from the holster, detecting the holster being removed from a user wearing the holster, detecting the system being removed from the holster, and/or the like.

The holster system 302 also includes a battery 322. The battery 322 may be a rechargeable battery. Additionally, the system may include wireless charging circuitry for recharging the battery 311 (not shown in FIG. 3). The holster system 302 may also include a low battery indicator (not shown in FIG. 3).

Figure 4:
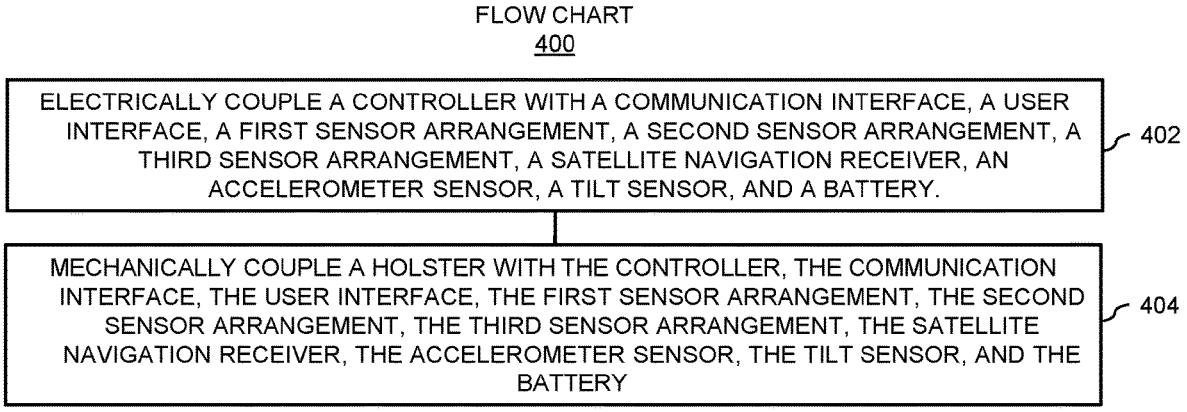
FIG. 4 depicts a flowchart illustrating a method of manufacturing the system of FIG. 3 in accordance with embodiments of the present disclosure.

FIG. 4 depicts a flowchart 400 illustrating a method of manufacturing the holster system 302 of FIG. 3 in accordance with embodiments of the present disclosure.

In step 402, the method includes electrically coupling the controller 302 with the communication interface 306, the user interface 308, the first sensor arrangement 310, the second sensor arrangement, 312, the third sensor arrangement 314, the satellite navigation receiver 318, the accelerometer sensor 318, the tilt sensor 320, and the battery 322.

In step 404, the method further includes mechanically coupling a holster with the controller 302, the communication interface 306, the user interface 308, the first sensor arrangement 310, the second sensor arrangement, 312, the third sensor arrangement 314, the satellite navigation receiver 318, the accelerometer sensor 318, the tilt sensor 320, and the battery 322.

Figure 5:
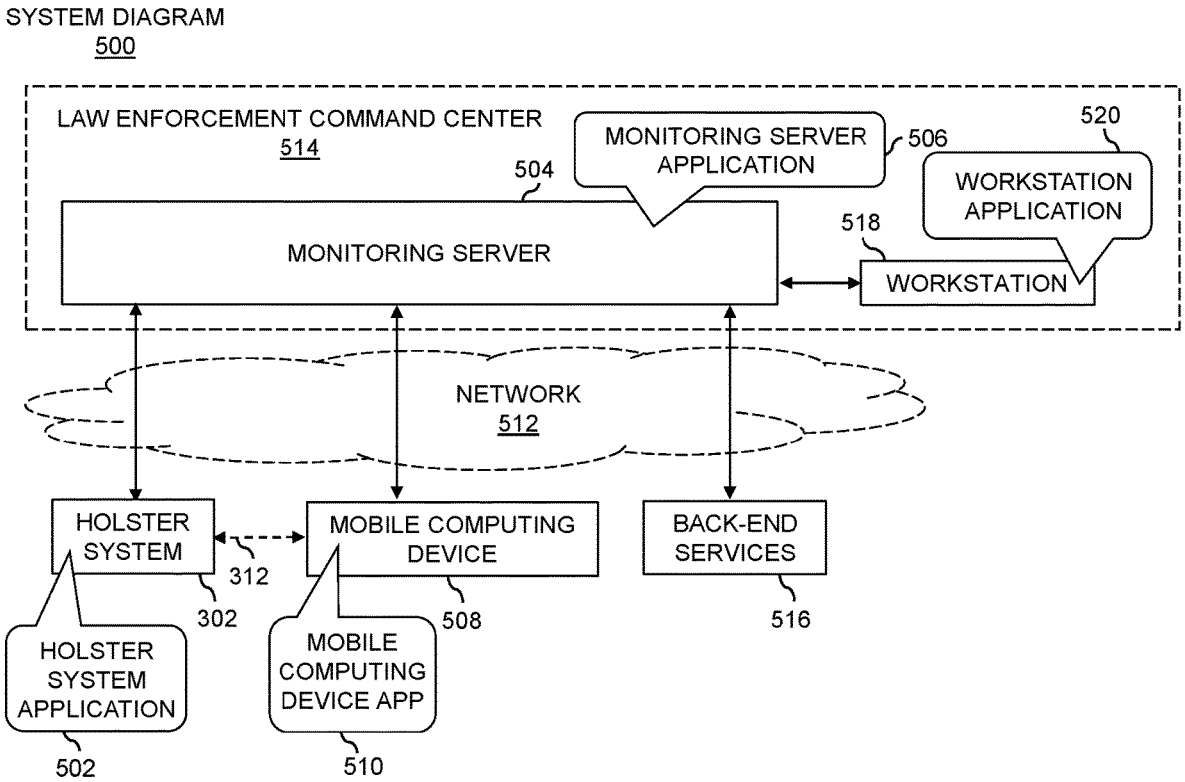
FIG. 5 depicts a system diagram illustrating the holster system of FIG. 3 executing a holster system application, a monitoring server executing a monitoring server application, and a mobile computing device executing a mobile computing device application (app) in accordance with embodiments of the present disclosure.

FIG. 5 depicts a system diagram 500 illustrating the holster system 302 of FIG. 3 executing a holster system application 502, a monitoring server 304 executing a monitoring server application 506, and a mobile computing device 508 executing a mobile computing device application (app) 510 in accordance with embodiments of the present disclosure. The holster system 302 and the mobile computing device 508 are configured to communicate over a PAN 512 when in proximity. The holster system 302 and the mobile computing device 508 are also configured to communicate with the monitoring server 504 over a network 512. The network 512 may include a cellular network. The cellular network may be compliant with a 2G network, a 3G network, a 4G network, a 5G network, and/or the like. The network 512 may also include the Internet.

The monitoring server 504 is housed in a law enforcement command center 514. In other embodiments, the monitoring server 504 may be housed within a cloud computing environment (not shown in FIG. 5). Additionally, the monitoring server 504 is configured to send and/or receive data from one or more back-end services 516 associated with law enforcement. For example, the one or more back-end services 516 may include 911 services and other first responder services to provide fast response backup to a law enforcement officer.

A workstation 518 executing a workstation application 520 is communicatively coupled with the monitoring server 504 within the law enforcement command center 514. In other embodiments, the workstation 518 may be remote and configured to communicate with the monitoring server 504 over the network 512. The workstation application 520 may be used for onboarding the holster system 302 and additional holster systems not shown in FIG. 5. In other embodiments, the mobile computing device app 510 may be used for onboarding the holster system 302.

Figure 6:
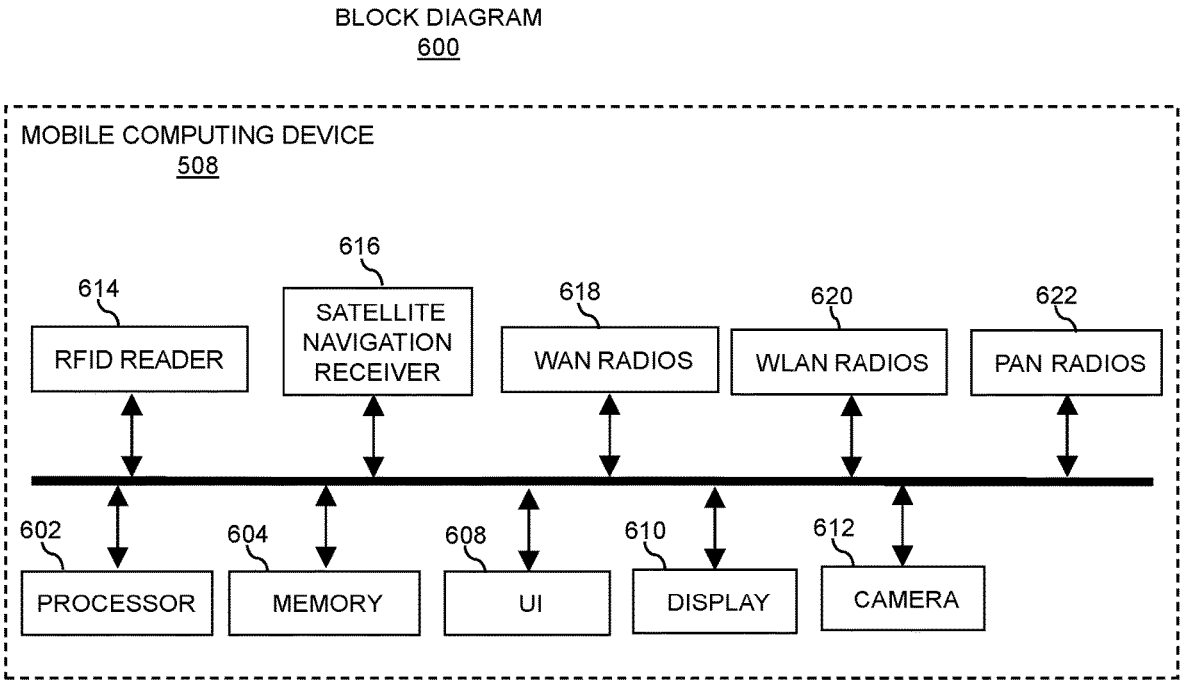
FIG. 6 depicts a block diagram illustrating the mobile computing device of FIG. 5 in accordance with embodiments of the present disclosure.

FIG. 6 depicts a block diagram 600 illustrating the mobile computing device 508 of the system diagram 500 of FIG. 5 in accordance with embodiments of the present disclosure. The mobile computing device 508 may be a smart phone (e.g., cell phone), a tablet, a laptop, a smart watch, or the like. The mobile computing device 508 includes a processor 602, a memory 604, a user interface (UI) 608, a display 610, a camera 612, a radio frequency identification (RFID) reader 614, a satellite navigation receiver 616, WAN radios, WLAN radios 620, and PAN radios 622. The mobile computing device 508 also includes a battery, a battery charger, and a charging port (not shown in FIG. 6). The mobile computing device 508 may also in include a near field communication (NFC) reader (not shown in FIG. 6).

In some embodiments the memory 604 or a portion of the memory 604 may be integrated with the processor 602. The memory 604 may include a combination of volatile memory (e.g., random access memory) and non-volatile memory (e.g., flash memory). The memory 604 includes program instructions (e.g., the mobile computing device app 510). In certain embodiments, the processor 602 may be a mobile processor such as the Qualcomm® Snapdragon® mobile processor. For example, the processor 602 may be the Snapdragon® 855 mobile processor. In some embodiments, the UI 608 and the display 610 may be combined into a graphical user interface (GUI). For example, the GUI may be a touchpad display. The camera 612 may be used to read a QR code on the holster system 302. The RFID reader 614 may be used to read an RFID tag on the holster system 302. Either of these methods may be used for onboarding of the holster system 302.

The satellite navigation receiver 616 may be configured to simultaneously receive three or more satellite signals from one or more of the previously described navigation systems with the holster system 302 of FIG. 3.

The WAN radios 618 are configured for communication over one or more wireless networks. The one or more wireless networks may be 2G networks, 3G networks, 4G networks, 5G networks, and/or the like. The WLAN radios 620 may include Wi-Fi technologies such as 802.11a, 802.11b/g/n, and/or 802.11ac, 802.11ad, and/or the like circuitry. The PAN radios 622 may include Bluetooth® and/or BLE technologies.

Figure 7:
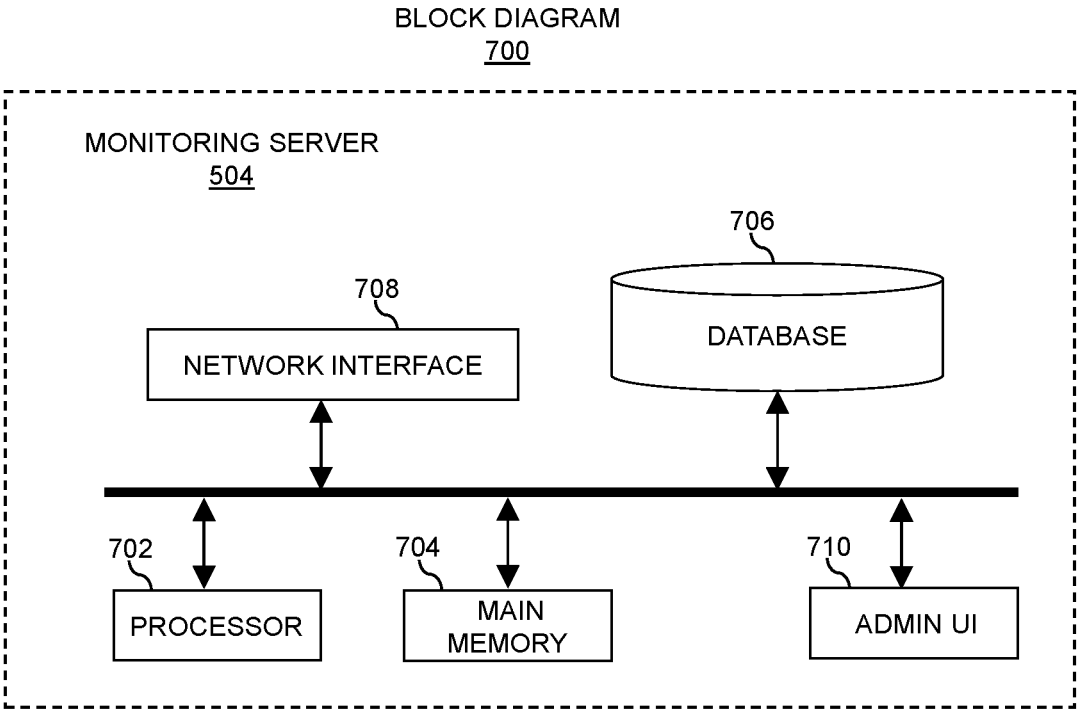
FIG. 7 depicts a block diagram illustrating the monitoring server of FIG. 5 in accordance with embodiments of the present disclosure.

FIG. 7 depicts one embodiment for a monitoring server 504 of FIG. 5 in accordance with embodiments of the present disclosure. The monitoring server 504 is a hardware server and may include a processor 702, a main memory 704, a database 706, a network interface 708, and an administration user interface (UI) 710. The monitoring server 504 may be configured to host a virtual server. For example, the virtual server may be an Ubuntu® server or the like. The monitoring server 504 may also be configured to host a virtual container. For example, the virtual container may be the Docker® virtual container or the like. In some embodiments, the virtual server and or virtual container may be distributed over a plurality of hardware servers using hypervisor technology. In addition to the law enforcement command center 514, the monitoring server 504 may be implemented in the Microsoft Azure®, the Amazon Web Services® (AWS), or the like cloud computing data center environments.

The processor 702 may be a multi-core server class processor suitable for hardware virtualization. The processor 702 may support at least a 64-bit architecture and a single instruction multiple data (SIMD) instruction set. The main memory 704 may include a combination of volatile memory (e.g., random access memory) and non-volatile memory (e.g., flash memory). The database 706 may include one or more hard drives. The database 706 may be configured to host rule sets and actions (including profiles) for individuals being provided confinement flexibility. In some embodiments, the database 706 may be an open source database such as the MongoDB® database, the PostgreSQL® database, or the like.

The network interface 708 may provide one or more high-speed communication ports to the data center switches, routers, and/or network storage appliances. The network interface 708 may include high-speed optical Ethernet, InfiniBand (IB), Internet Small Computer System Interface iSCSI, and/or Fibre Channel interfaces. The administration UI 710 may support local and/or remote configuration of the monitoring server 504 by a data center administrator and/or an employee of law enforcement command center 514.

Figure 8:
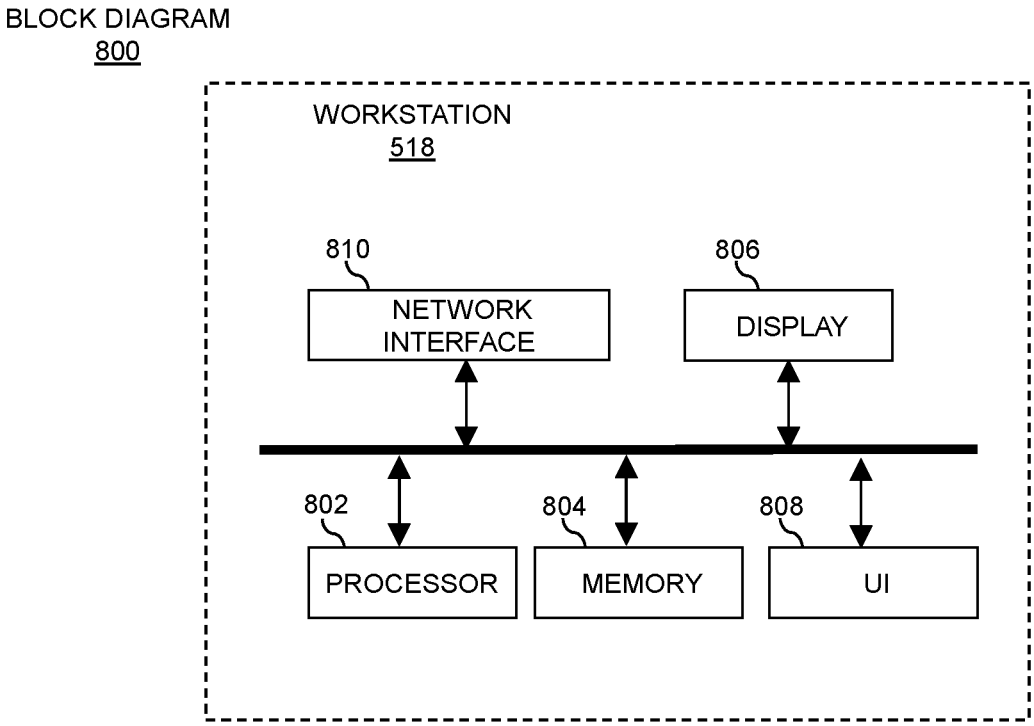
FIG. 8 depicts a block diagram illustrating the workstation of FIG. 5 in accordance with embodiments of the present disclosure.

FIG. 8 depicts a block diagram 800 illustrating the workstation 518 of the system 500 described in FIG. 5 in accordance with embodiments of the present disclosure. The workstation 518 may be configured to communicate with the monitoring server 504 directly or over the network 512 in a similar manner as described in the system 500 of FIG. 5. The workstation 518 may be configured to host a specific application (e.g., the workstation application 520). The workstation 518 includes at least one processor 802, a memory 804, a display 806, a user interface (UI) 808, and a network interface 810.

The workstation 518 may include an operating system (OS) such as a Windows® OS, a Macintosh® OS, a Linux® OS, or the like. The memory 804 may include a combination of volatile memory (e.g., random access memory) and non-volatile memory (e.g., solid state drive and/or hard drives). The display 806 may be an external display (e.g., computer monitor) or internal display (e.g., laptop). The UI 808 may include a keyboard, and a pointing device (e.g., mouse). The network interface 810 may be a wired Ethernet interface or a Wi-Fi interface.

Figure 9:
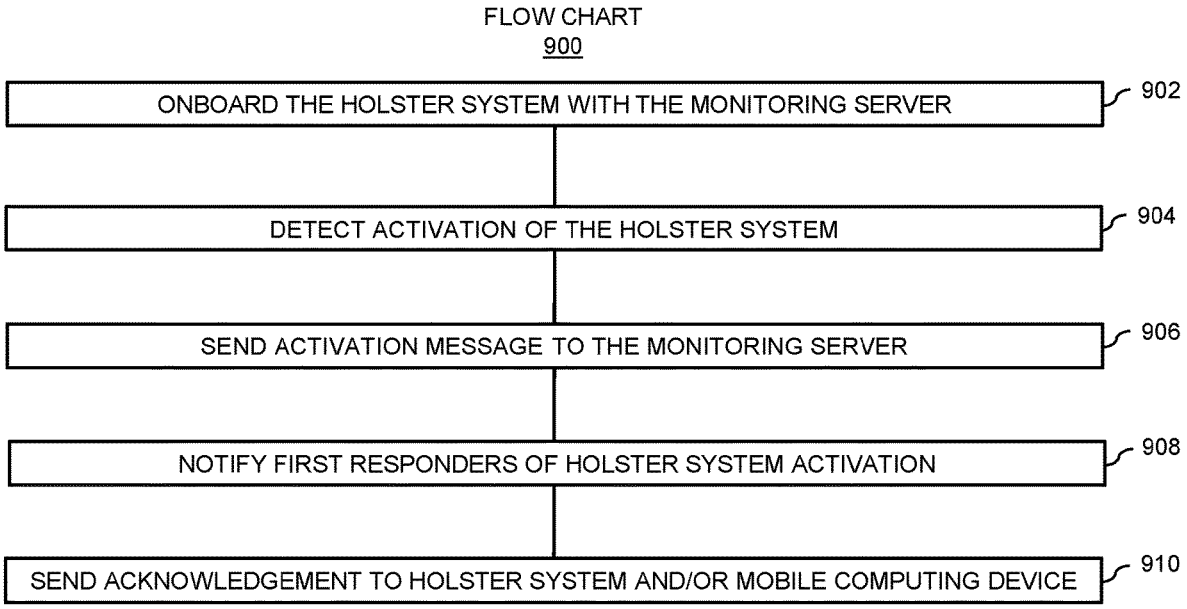
FIG. 9 depicts a flow chart illustrating a method implemented within the components illustrated in the system diagram of FIG. 5 in accordance with the embodiments of the present disclosure.

FIG. 9 depicts a flow chart 900 illustrating a method implemented within the components illustrated in the system diagram 500 of FIG. 5 in accordance with the embodiments of the present disclosure.

In step 902, the method includes onboarding the holster system 302 with the monitoring server 504. The onboarding may be completed by a member of law enforcement targeted to wear the holster system. In other embodiments, the onboarding may be completed by an employee of the law enforcement command center 514 using the workstation application 520.

In step 904, the method further includes detecting activation of the holster system 302. The activation may be based on a weapon withdrawn from a holster attached to the holster system 302, detecting a hand being placed on the holster and/or holster system 302, a panic button being activated on the holster system 302, and/or motion of the holster system 302 deemed to possibly be the wearer of the holster system in distress. For example, one or more of the previously described sensors may detect violent motion and/or a non-normal position of the holster system while being worn. The user interface may also allow one or more methods of activation to be disabled.

In step 906, the method further includes sending an activation message to the monitoring server 504 from the holster system 302. The activation message may include a unique identifier (ID) associated with the holster system 302, a current location of the holster system 302, and the type of activation (e.g., weapon withdrawn, hand placed on holster, and/or panic button activation). The activation message may be sent directly from the holster system 302 over the network 512 or via the mobile computing device 508. The activation message may also include the type of activation (e.g., In step 908, the method further includes the monitoring server 504 notifying first responders directly or via the back-end services 516.

In step 910, the method further includes the monitoring server 504 sending an acknowledgment to the holster system 302 and/or the mobile computing device 508 confirming first responders have been notified.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function (s). It should also be noted, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The descriptions of the various embodiments of the present invention have been presented for purposes of illustration but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A system for monitoring usage of a holster, the system comprising:

a controller;

a satellite navigation receiver electrically coupled with the controller;

a communication interface electrically coupled with the controller;

a first sensor arrangement electrically coupled with the controller and configured for detecting removal of a tool from the holster; and a distress button electrically coupled with the controller;

an accelerometer sensor electrically coupled with the controller; and a tilt sensor electrically coupled with the controller, wherein the controller is configured for:

logging an event time and an event location associated with detecting an activation of the distress button;

transmitting a distress signal via the communication interface to an external computing device upon detecting the activation of the distress button;

detecting a pattern of frequent movement of the holster indicating a possible struggle; and transmitting the distress signal based on detecting the pattern of frequent movement, wherein:

the distress signal comprises the event time and event location; and the external computing device is located in at least one of a law enforcement vehicle and a law enforcement command center.

2. The system of claim 1, wherein the holster is configured to restrict undesired movement of the tool.

3. The system of claim 2, wherein the tool is at least one of a handgun, an electroshock weapon, and a spray canister.

4. The system of claim 3, wherein the handgun is at least one of a semi-automatic pistol and a revolver.

5. The system of claim 3, wherein the electroshock weapon is a taser.

6. The system of claim 3, wherein the spray canister is a pepper spray canister.

7. The system of claim 1, wherein the communication interface is a wireless communication interface.

8. The system of claim 7, wherein the wireless communication interface is configured to communicate over a personal area network.

9. The system of claim 7, wherein the wireless communication interface is configured to communicate over a wide area network.

10. The system of claim 1, wherein the controller is configured for transmitting a message via the communication interface to the external computing device upon detecting the tool being removed from the holster.

11. The system of claim 1 further comprising a second sensor arrangement electrically coupled with the controller and configured for detecting presence of a hand positioned for removal of the tool and the controller is configured for transmitting a first message via the communication interface to the external computing device upon detecting the presence of the hand positioned for removing the tool from the holster.

12. The system of claim 11 further comprising a third sensor arrangement electrically coupled with the controller and configured for at least one of detecting the holster being removed from a user wearing the holster and detecting the system being removed from the holster.

13. The system of claim 12, wherein the controller is further configured for transmitting a second message via the communication interface to the external computing device upon at least one of detecting the holster being removed from the user wearing the holster and detecting the system being removed from the holster.

14. The system of claim 12, wherein the third sensor arrangement comprises at least one an infrared proximity sensor and a capacitive proximity sensor.

15. The system of claim 11, wherein the second sensor arrangement comprises at least one an infrared proximity sensor and a capacitive proximity sensor.

16. The system of claim 1, wherein the holster is configured to be mechanically coupled with at least one of a belt, a shoulder harness, a calf strap, an ankle band, a jacket, a vest, and a waist band.

17. The system of claim 1, wherein the distress button is positioned on a side of the holster.

18. The system of claim 17, wherein the controller is further configured for detecting the activation of the distress button based on a user activating the distress button for at least three seconds.

19. The system of claim 1, wherein the satellite navigation receiver is configured to determine an approximate location of the system.

20. A method of manufacturing a system for monitoring usage of a holster, the method comprising:

electrically coupling a communication interface with a controller;

electrically coupling a satellite navigation receiver with the controller;

electrically coupling a first sensor arrangement with the controller, wherein the first sensor arrangement is configured for detecting removal of a tool from the holster; and electrically coupling a distress button with the controller;

electrically coupling an accelerometer sensor with the controller;

electrically coupling a tilt sensor with the controller, wherein the controller is configured for:

logging an event time and an event location associated with detecting an activation of the distress button;

transmitting a distress signal via the communication interface to an external computing device upon detecting the activation of the distress button;

detecting a pattern of frequent movement of the holster indicating a possible struggle; and transmitting the distress signal based on detecting the pattern of frequent movement, wherein:

the distress signal comprises the event time and event location; and the external computing device is located in at least one of a law enforcement vehicle and a law enforcement command center.

* * * * *